US007021054B2

(12) United States Patent
Alderson et al.

(10) Patent No.: US 7,021,054 B2
(45) Date of Patent: Apr. 4, 2006

(54) STIRLING ENGINE ASSEMBLY

(75) Inventors: John Howard Alderson, Matlock (GB); Jennifer Jane Lamb, Sutton Coldfield (GB); Julie Patricia Hyde, Meriden (GB); Heather Allderidge, Derby (GB); David Anthony Clark, Hugglescote (GB)

(73) Assignee: Microgen Energy Limited, (GB)

( * ) Notice: Subject to any disclaimer, the term of this patent is extended or adjusted under 35 U.S.C. 154(b) by 0 days.

(21) Appl. No.: 10/514,297

(22) PCT Filed: May 13, 2003

(86) PCT No.: PCT/GB03/02058

§ 371 (c)(1),
(2), (4) Date: Nov. 12, 2004

(87) PCT Pub. No.: WO03/095822

PCT Pub. Date: Nov. 20, 2003

(65) Prior Publication Data

US 2005/0166590 A1 Aug. 4, 2005

(30) Foreign Application Priority Data

May 13, 2002 (GB) ..... 0210929

(51) Int. Cl.
*F01B 29/10* (2006.01)

(52) U.S. Cl. ..... 60/517; 60/524

(58) Field of Classification Search ..... 60/517, 60/524

See application file for complete search history.

(56) References Cited

U.S. PATENT DOCUMENTS

| | | | | | |
|---|---|---|---|---|---|
| 3,530,681 | A | * | 9/1970 | Dehne | 62/6 |
| 3,831,380 | A | | 8/1974 | Nederlof | |
| 3,984,982 | A | * | 10/1976 | Hagen et al. | 60/520 |
| 4,055,953 | A | | 11/1977 | Nederlof | |
| 4,253,303 | A | | 3/1981 | Liljequist | |
| 4,365,474 | A | | 12/1982 | Carlqvist | |
| 4,381,648 | A | * | 5/1983 | Balas, Jr. | 60/517 |
| 4,495,771 | A | | 1/1985 | Chauveton | |
| 4,573,320 | A | | 3/1986 | Kralick | |
| 4,723,410 | A | | 2/1988 | Otters | |
| 4,742,679 | A | | 5/1988 | Inoda et al. | |
| 4,774,808 | A | | 10/1988 | Otters | |
| 4,870,821 | A | * | 10/1989 | Harada et al. | 60/520 |

* cited by examiner

*Primary Examiner*—Hoang Nguyen
(74) *Attorney, Agent, or Firm*—Needle & Rosenberg, P.C.

(57) ABSTRACT

A Stirling engine assembly comprising a Stirling engine (1) with a hot head (3) and a cold region (4). An annular burner (9) surrounds the head and is arranged to provide heat to the head. A corrugated seal (2) between the Stirling engine and the burner prevents the flow of combustion gases from the head into the surrounding environment. The Stirling engine is supported by a mounting frame (23) at least in part via the seal.

13 Claims, 5 Drawing Sheets

FIG. 1.
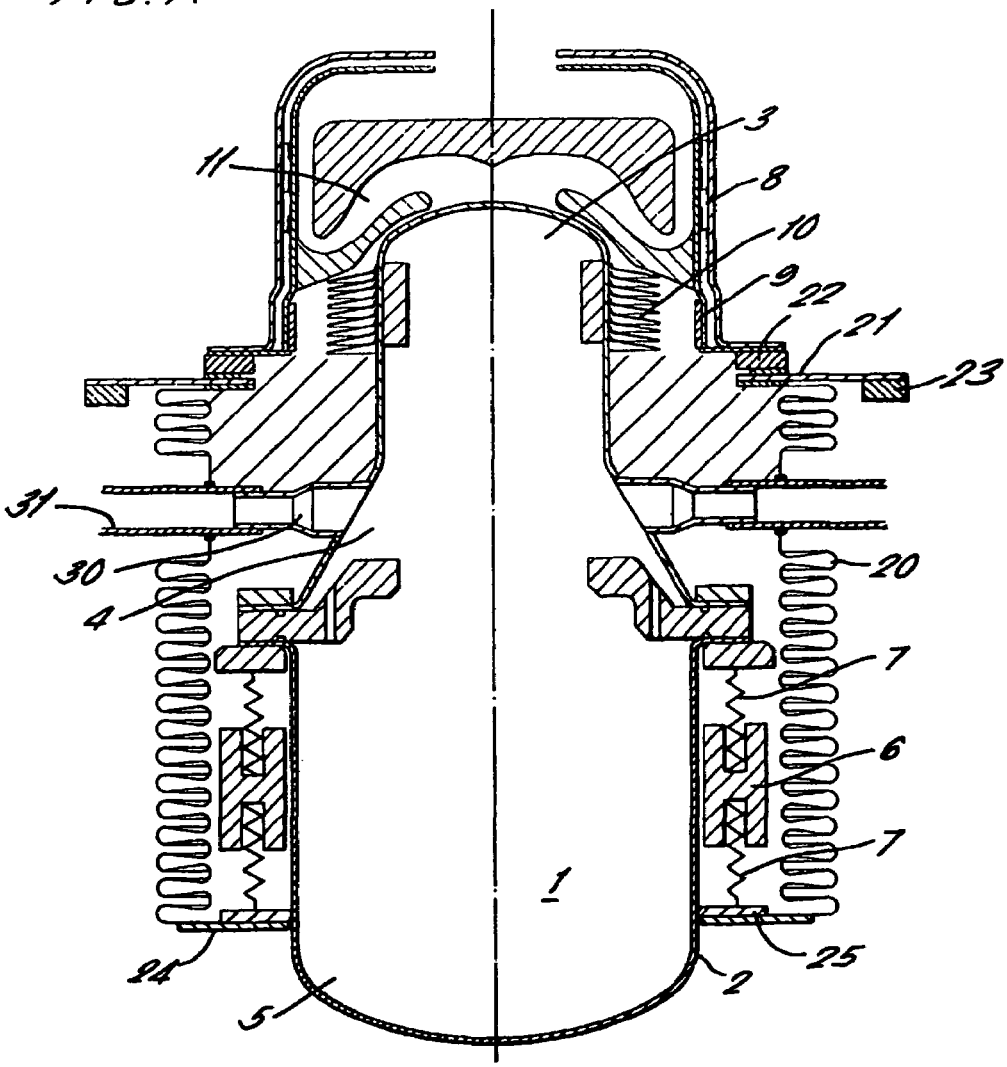
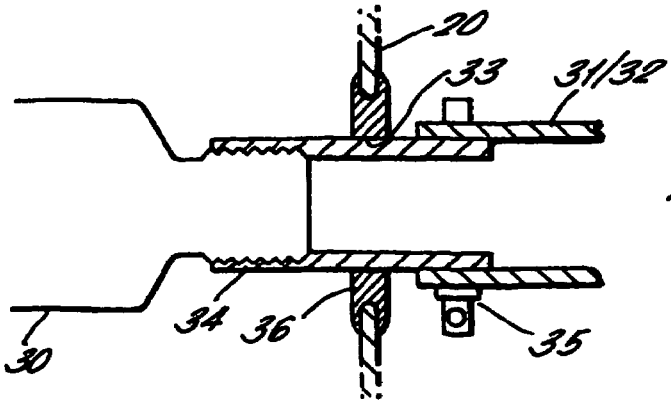
FIG. 1A

STIRLING ENGINE ASSEMBLY

CROSS REFERENCE TO RELATED APPLICATIONS

The present application claims priority to Great Britain Application No. 0210929.6, filed May 13, 2002, which application is incorporated herein fully by this reference.

The present invention relates to a Stirling engine assembly. In particular, the invention relates to an assembly suitable for use in a combinded heat and power (chp) unit.

Where an appliance, such as a chp unit, is installed in a domestic environment, it is vital that noise and vibration that could cause a considerable nuisance, is kept to a very low level. As the appliance contains a Stirling engine, combined with an alternator, it produces a considerably higher level of noise and vibration than would be acceptable. It is therefore necessary to minimise the transmission of noise and vibration to the domestic environment, through the casing and support frame of the combined heat and power unit.

A Stirling engine burner is located around the heater head at the top of the engine. A problem for the Stirling engine-based chp system is the need to ensure that combustion gases do not flow downwards into the room-sealed unit enclosure, causing the accumulation of potentially harmful gases. Some form of seal is therefore required between the Stirling engine and the burner casing.

When operating, the Stirling engine vibrates, due to its reciprocating components. A vibration reduction system, incorporating various damping and absorbing components can bring the residual levels of vibration to a low level, but there is still enough to cause problems to any seal located between the vibrating engine and the stationary burner casing. The seal design is required to be extremely robust, operate at high temperatures, and be capable of maintaining an adequate seal under all operating conditions, as defined by the gas appliance certification procedure. Some conventional seal designs are typically significantly stiffer than the engine suspension system and would, if used in the application, lead to unacceptable transmission of forces between the oscillating engine and the static burner components.

Excessive wear, fatigue or degradation of such a seal would cause combustion gases to leak into the unit enclosure, causing a hazard, and increasing noise levels.

U.S. Pat. No. 5,918,463 discloses a Stirling engine with a washer shaped piece of flexible, semi rigid, or rigid fibrous ceramic insulation between the burner casing and Stirling engine.

The usual practice is to support an engine by mounting it on top of springs, which isolate a large proportion of the vibration produced during normal engine operation. An example of a Stirling engine having such an arrangement is U.S. Pat. No. 4,400,941. To maximise the degree of isolation, a low stiffness mounting system is required. The implementation of this, with compression springs, can lead to instability, especially where the forces involved are lateral in nature in addition to vertical oscillations. An alternative support arrangement is therefore necessary. Our previous patent application PCT/GB 02/05111 details a solution to this problem, where springs are arranged around the outer surface of the Stirling engine, to suspend the engine from a mounting flange.

According to the present invention, there is provided a Stirling engine assembly comprising a Stirling engine with a hot head and a cold region, an annular burner surrounding the head and arranged to provide heat to the head, and a corrugated seal between the Stirling engine and the burner to prevent the flow of combustion gases from the head into the surrounding environment, wherein the Stirling engine is supported by a mounting frame at least in part via the seal.

The seal design can thus be made to be flexible enough to cope with the relative motion (both vertical, horizontal and rotational in nature) between engine and burner. In addition, suitable materials for the seal are available which can withstand the high temperatures associated with the burner gases, and are not corroded by the gases involved.

By supporting the Stirling engine by a mounting frame at least in part via the seal, an arrangement is provided which supports the engine which isolates a large proportion of the vibration, while, at the same time, providing a highly effective seal preventing combustion gases from escaping into the body of the chp unit casing.

As part of the weight of the Stirling engine is supported by the seal, the suspension system can be made lighter as it supports less weight, or can even be removed altogether with obvious cost advantages.

Insulation is preferably provided between the seal and the engine to substantially reduce the passage of hot combustion gases from the burner towards the bellows.

The seal may, for example, be a bellows.

The bellows may be arranged such that it extends from a location adjacent to the burner, along a substantial portion of the length of the Stirling engine. In this case, means are provided for passing coolant through the bellows to provide a flow of coolant liquid to and from an engine cooler. This preferably entails a coolant inlet and coolant outlet pipe extending through the bellows and being sealed by a flexible seal. The bellows is preferably provided in this region, with a cylindrical portion. This elongate bellows design reduces the levels of transmitted noise from the Stirling engine by providing a sealed gas cushion around the body of the engine. In the same way, however, this gas cushion may insulate the engine and reduce heat losses from the casing. As the alternator, in particular, relies on air cooling around the lower engine/absorber casing to maintain the temperature of the magnet at an operational level, this may be disadvantageous. To overcome this, it is possible to add cooling fins to the exposed lower end of the engine to aid heat loss, thereby compensating for the warming effect of the bellows.

As an alternative to the bellows extending along a substantial length of the engine, the bellows may terminate above an engine cooler. In this case, there is no need for the coolant to pass through the bellows.

If the bellows is arranged to extend vertically, the weight of the Stirling engine is borne along the length of the bellows. However, the bellows may be arranged at an angle to the vertical.

The weight of the Stirling engine may be borne entirely by the bellows. Alternatively, the weight of the Stirling engine is borne partially by the bellows and partially by one or more additional resilient members. Such as springs from which the engine is suspended.

Examples of Stirling engine assemblies in accordance with the present invention will now be described with reference to the accompanying drawings, in which:

FIG. 1 is a schematic section of a first example;

FIG. 1*a* shows a portion of FIG. 1 in greater detail;

FIG. 2 is a view similar to FIG. 1 showing a second example;

FIGS. 3*a* and 3*b* are cross-sections of alternative bellows sections;

Figure 2:
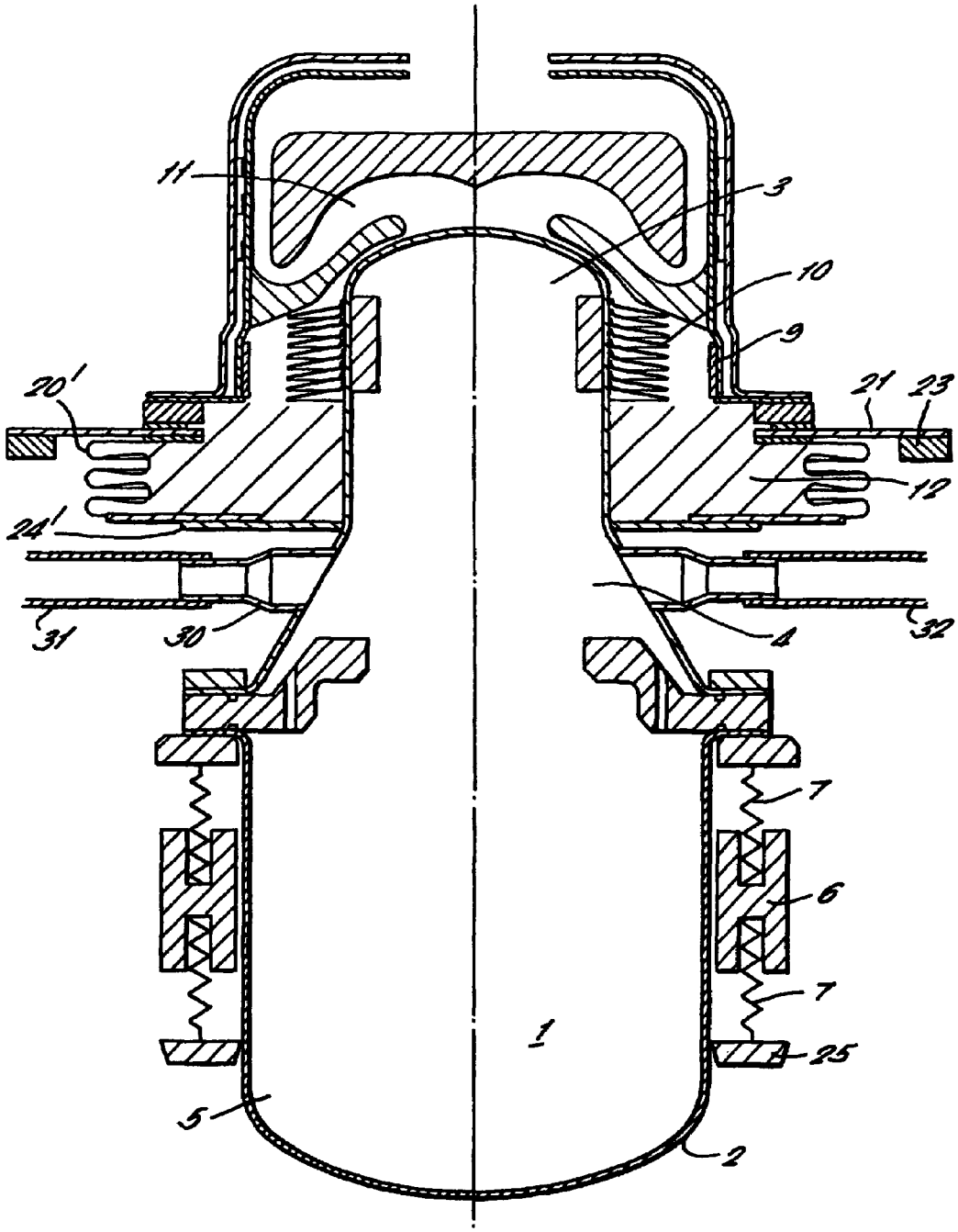

The Stirling engine assembly comprises a Stirling engine 1 housed within a casing 2. The design of the Stirling engine 1 is well-known in the art. The engine is broadly divided into three segments, a heater head 3, a cooler 4 and an alternator 5. The engine has displacer and power pistons, both of which are arranged to reciprocate in a vertical direction. This produces a net vertical vibration of the Stirling engine itself. In order to reduce this vibration, an annular absorber mass 6 is supported by a number of compression springs 7 both above and below the absorber mass.

In order to transfer heat to the heater head 3, a gas/air mixture is supplied along an inlet duct 8 to a burner element 9 where it is ignited. The heat generated is transferred to a heater head 3 via a plurality of annular fins 10. The combustion gases flow up through the fins 10 around the top of the heater head and into a recuperator 11 in which they preheat the incoming gas/air mixture and subsequently heat water for domestic use. Ceramic fibre insulation 12 increases the resistance to downward gas flow so that very little downward gas flow occurs.

The combustion gases are prevented from escaping into the external environment by the presence of an annular seal in the form of bellows 20 surrounding the Stirling engine 1. At its top end, the bellows has an annular flange 21 which is bolted to the lower surface of the burner/recuperator assembly 22. This flange 21 sits on the unit frame 23. This frame 23 is a rigid box frame attached to the wall of a dwelling. At its lower end, the bellows 20 terminates in a lower annular flange 24 which is bolted or connected using a clamping ring to a mounting ring 25 which is welded around a lower portion of the casing 2 of the Stirling engine 1 adjacent to the alternator 5. In this way, the weight of the Stirling engine 1 including the fins 10 together with the vibration absorber 6 and its associated mountings are all supported on the unit frame 23 via the bellows 20.

In order to circulate cooling liquid around the cooler 4, it is necessary to provide flow of coolant to and from the cooler. An annular coolant duct 30 surrounds the casing 2 in the vicinity of the cooler 4. This annular duct is fed with coolant liquid from an inlet pipe 31, while the outlet from the duct 30 is via outlet pipe 32. The inlet 31 and outlet 32 pipes extend through the wall of the bellows 20 as shown in greater detail in FIG. 1*a*. At this location, the wall of the bellows 20 is cylindrical and is provided with a pair of circular openings 33. A rigid pipe extension 34 which is screwed to the annular duct 30 passes through the opening 33. The inlet 31/outlet 32 pipe (as the case may be) is fastened to the rigid pipe extension 34 using a jubilee clip with a clamping ring 35. At each opening 33, a seal is made using a flexible rubber grommet seal 36. This seal presses against the rigid pipe extension 34. This arrangement will allow the pipes 31/32 to vibrate without damage. As the grommet seals 36 are in contact with the coolant pipes, the temperature in this region is low enough to allow the use of a commercially available rubber seal, giving low rates of wear for components in this area.

As it is not intended that the Stirling engine should be serviced on site, there is no requirement for access to the components that will be sealed within the bellows 20. If an engine failure occurs, the engine will be removed, repaired and replaced as a single module (including bellows). The rigid pipe extensions 34 and grommet seals 33 could, however, be replaced at service intervals.

A second example of a Stirling engine assembly in accordance with the present invention is shown in FIG. 2. This is largely the same as the example shown in FIG. 1, with the same reference numerals having been used to designate the same components. A further description of these common components is not repeated here.

The second example differs from the first example in that the bellows 20' terminates above the cooler 4. In this case, the upper mounting is the same as for the first example, but the lower mounting is via a mounting plate 24' welded around the casing 2 above the cooler 4. In this case, neither the annular absorber mass 6, nor the annular coolant duct 30 are within the bellows. There is therefore no need to provide an interface between the coolant inlet 31/outlet 32 pipes and the bellows.

With this arrangement, the Stirling engine 1 including the fins 10 together with the vibration absorber 6 are suspended from the unit frame 23 via the bellows 20'.

Figure 3A:
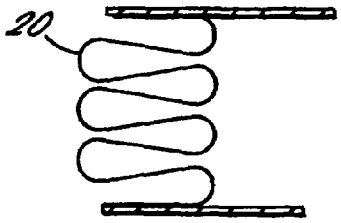
Figure 3B:
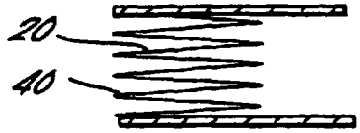

The bellows 20 consists of a flexible stainless steel (AISI 32 or AISI 316Ti) tube with annular corrugated convolutions. The most cost effective cross-sectional shape of bellows is the rounded-end section of FIGS. 1 and 2 and as shown in more detail in FIG. 3*a*. These are made by a hydraulic forming process. Alternatively, the cross-section may have sharp edges 40 which are each welded. The rounded section bellows also has more advantageous properties in terms of allowing relative lateral movement between its ends. This can be important where vibrational forces produced by the Stirling engine can be horizontal as well as vertical and reduces transmission of forces within the system.

Typically, the weight of the Stirling engine 1 and absorber mass 6 is 20 to 100 kilograms. The stiffness of the bellows is adjusted to match the engine weight and also the space available for allowable extension.

Typically, for the engine of FIG. 1 there will be 3 to 4 convolutions above the cooler 4 and 12 to 18 convolutions beneath the cooler 4. In the short bellows of FIG. 2, there will be typically 3 to 4 convolutions. The stiffness per convolution is 380 N/mm to 50 N/mm for a 60 kilogram engine. The stiffness per convolution is varied by altering the outside diameter of the bellows, while keeping the inside diameter constant. Lower stiffness has the advantage of reducing vibration levels, but needs to be balanced against the additional weight and the extra space needed around the engine.

Figure 4:
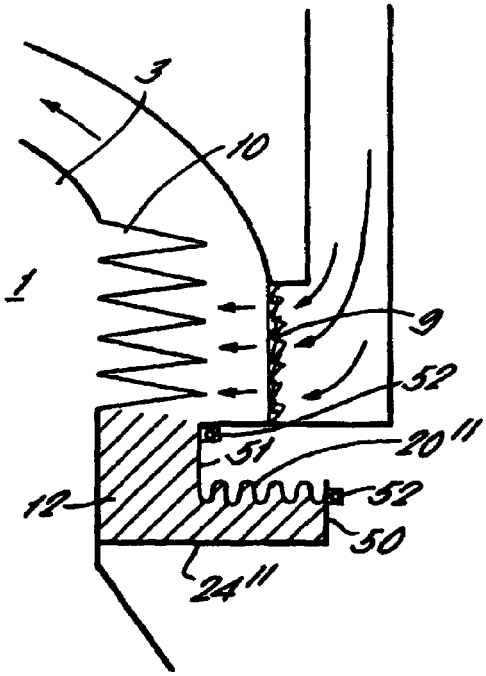
FIG. 4 is a cross-section through part of a Stirling engine showing an alternative seal configuration which is not in accordance with the present invention.
Figure 5:
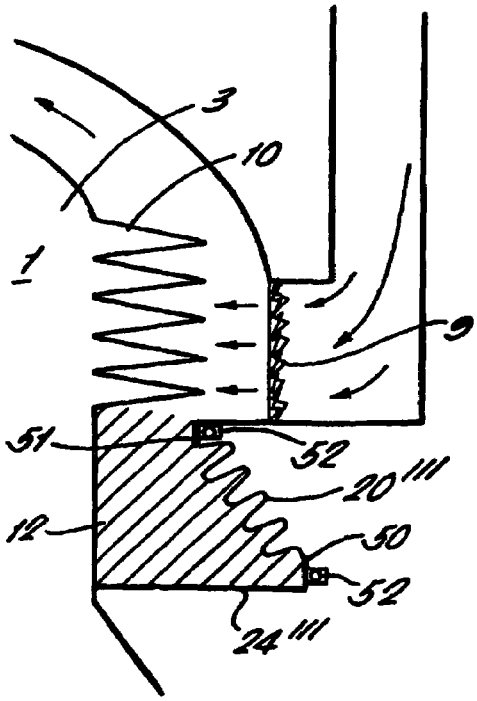
FIG. 5 is a view similar to FIG. 4 showing a further bellows arrangement.

Alternatives to the vertically extending bellows are shown in FIGS. 4 and 5. These examples are, in all other ways, similar to FIG. 2.

FIG. 4 shows an annular disc 20" with concentric annular convolutions which are convoluted in a direction perpendicular to the plane of the disc. In this case, mounting plate 24" has an upwardly extending annular flange 50, while a downwardly annular flange 51 depends from the casing of the burner 9. The seal 20" is mounted between these two flanges and held in place with annular clips 52. Such an arrangement, however, is not capable of supporting any of the weight of the engine and is therefore not a part of the present invention.

A similar arrangement is shown in FIG. 5, but in this case the seal is a bellows 20''' which is angled at around 45° to the horizontal.

Figure 6:
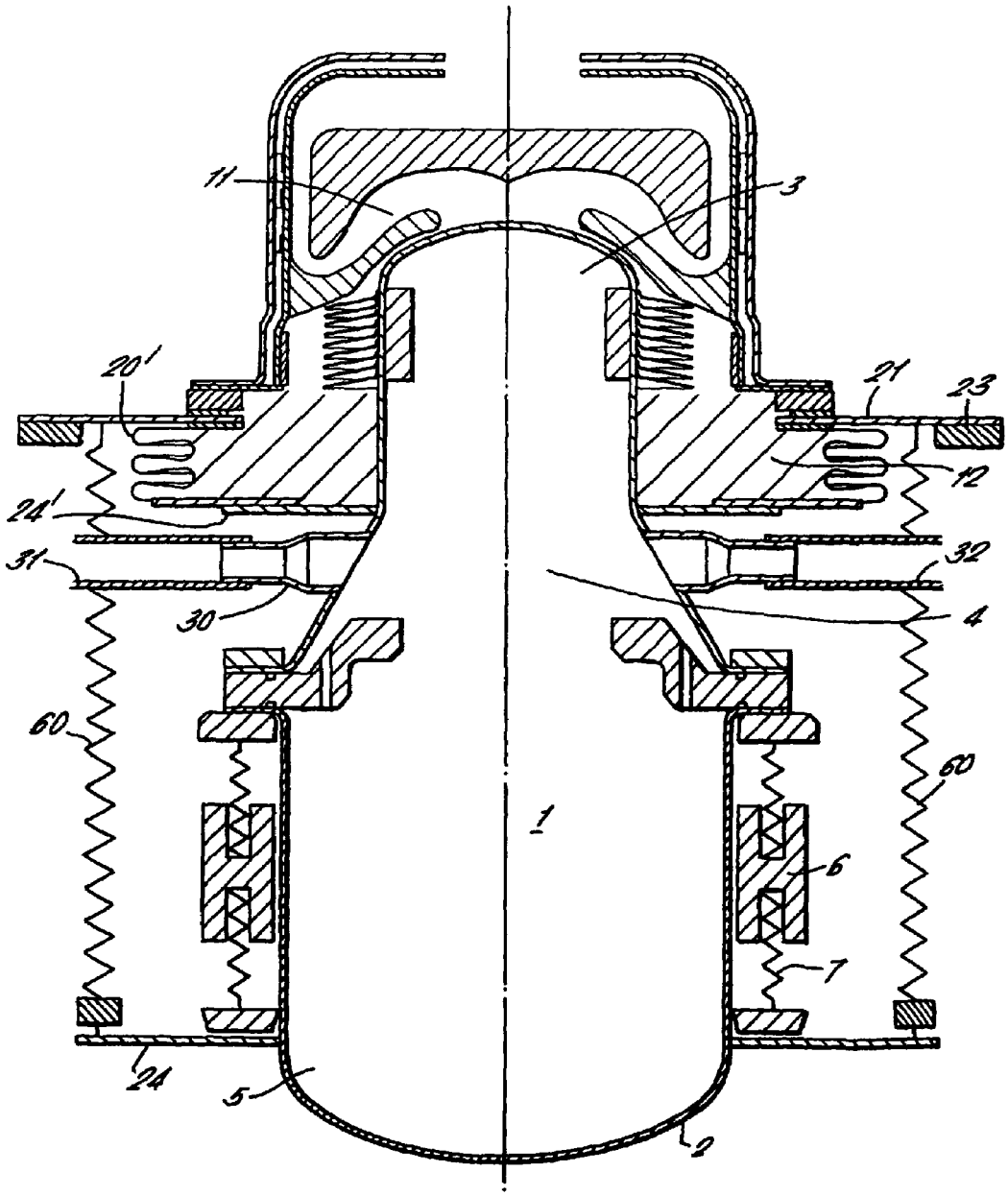
FIG. 6 is a view similar to FIG. 2 showing a third example.

In the examples described to date, all of the weight of the Stirling engine 1 and absorber mass 6 is suspended through the seal 20. As an alternative, as shown in FIG. 6 the seal may bear some of the weight of the Stirling engine 1 and absorber mass 6, while some additional suspension for the Stirling engine 1 and absorber mass 6 is provided. This may be in the form of a plurality of springs 60 which are arranged around the engine and are attached between the unit frame 23 and the lower flange 24. This allows the size and therefore the weight and cost of the bellows to be reduced. In this case, spring failure would not be as serious as failure of the bellows suspension, so that this arrangement reduces risk of costly chp down-time. However, the weight and cost reduction of the seal must be balanced against the additional components required with this arrangement with their associated additional weight and cost. Although FIG. 6 is shown with a bellows similar to that in FIG. 2, it would also be possible to use any of the alternative configurations of FIGS. 1 and 3 to 5.

Figure 7:
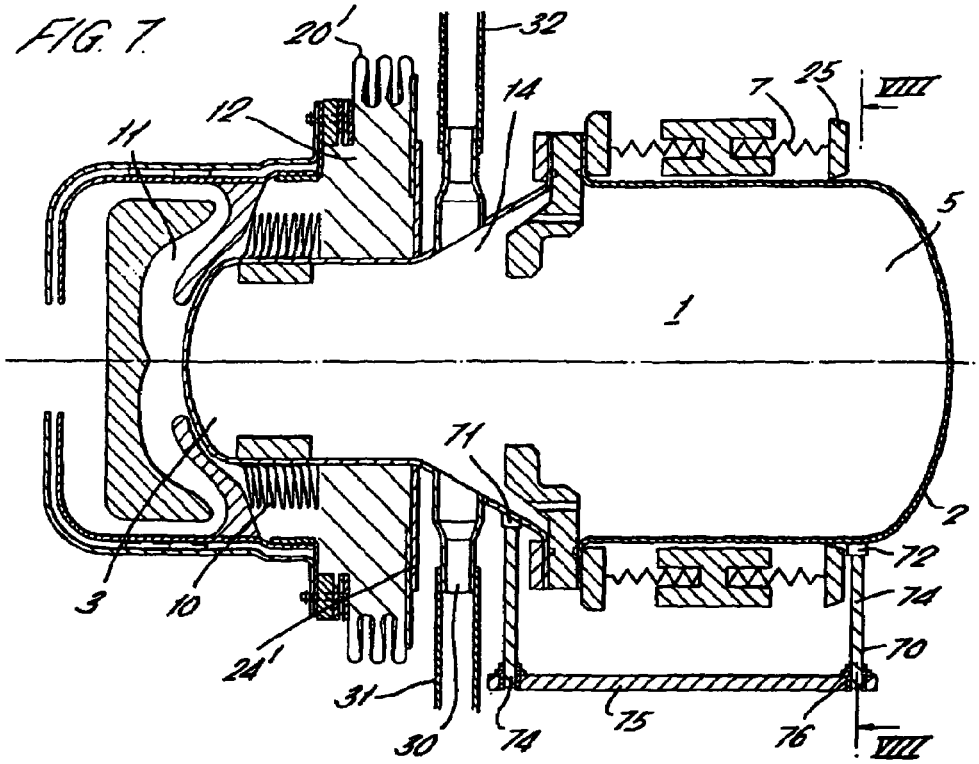
FIG. 7 is a view similar to FIG. 2 showing an example which is not in accordance with the invention.
Figure 8:
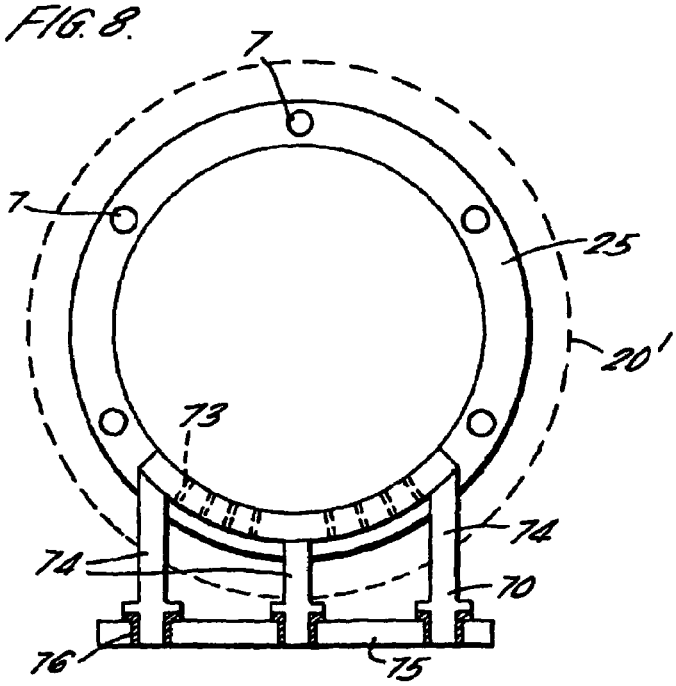
FIG. 8 is a section through line VIII—VIII in FIG. 7.

FIG. 7 shows a Stirling engine assembly in which the Stirling engine is mounted horizontally. Most aspects of the Stirling engine assembly are similar to that shown in FIG. 2 and are not described in further detail here. In this case, the bellows 20 is acting purely as a seal and does not bear any weight of the Stirling engine assembly. This example therefore does not form part of the present invention. The annular disc 20" of FIG. 4 is particularly suited to this type of horizontal mounting.

Instead, the weight of the assembly is carried by a support 70. This comprises two arcuate brackets 71, 72 attached to the engine 1 adjacent to the cooler 4 and to the end of the alternator 5 respectively. Cooling passages 73 within the brackets 71, 72 permit the flow of air and prevent the temperature of the casing 2 adjacent to the alternator from rising to unacceptable levels. Legs 74 extend from each of arcuate bracket into a base 75 in which they are retained in by rubber seats 76 to reduce the transmission of vibration to the base 75.

The invention claimed is:

1. A Stirling engine assembly comprising a Stirling engine with a hot head and a cold region, an annular burner surrounding the head and arranged to provide heat to the head, and a corrugated seal between the Stirling engine and the burner to prevent the flow of combustion gases from the head into the surrounding environment, wherein the Stirling engine is supported by a mounting frame at least in part via the seal.

2. An assembly according to claim 1, wherein insulation is provided between the seal and the engine to substantially reduce the passage of hot combustion gases from the burner towards the seal.

3. A Stirling engine assembly according to claim 1, wherein the seal is a bellows.

4. An assembly according to claim 3, wherein the bellows extends from a location adjacent to the burner, along a substantial portion of the length of the Stirling engine.

5. An assembly according to claim 4, wherein means are provided for passing coolant through the bellows to provide a flow of coolant to and from an engine cooler.

6. An assembly according to claim 5, further comprising a coolant inlet and a coolant outlet pipe extending through the bellows and being sealed by a flexible seal.

7. An assembly according to claim 4, wherein the bellows is cylindrical in the region of the engine cooler.

8. An assembly according to claim 3, wherein the bellows terminate above the engine cooler.

9. An assembly according to claim 3, wherein the bellows is arranged to extend vertically such that the weight of the Stirling engine is borne along the length of the bellows.

10. An assembly according to claim 3, wherein the bellows is arranged at an angle to the vertical.

11. An assembly according to claim 3, wherein the weight of the engine is borne entirely by the bellows.

12. An assembly according to claim 3, wherein the weight of the Stirling engine is borne partially by the bellows and partially by one or more additional resilient members.

13. An assembly according to claim 12, wherein the additional resilient members are springs from which the engine is suspended.

* * * * *